US006276686B1

(12) United States Patent
Chille

(10) Patent No.: US 6,276,686 B1
(45) Date of Patent: Aug. 21, 2001

(54) BOARD GAME AND METHOD FOR TEACHING RESPONSIBLE DRINKING

(76) Inventor: Richard A. Chille, 5 Jane, Seldon, NY (US) 11784

( * ) Notice: Subject to any disclaimer, the term of this patent is extended or adjusted under 35 U.S.C. 154(b) by 0 days.

(21) Appl. No.: 09/654,231

(22) Filed: Sep. 2, 2000

Related U.S. Application Data

(60) Provisional application No. 60/152,474, filed on Sep. 3, 1999.

(51) Int. Cl.[7] ..... A63F 3/00

(52) U.S. Cl. ..... 273/243; 273/248; 273/431

(58) Field of Search ..... 273/243, 248, 273/431, 252, 251, 253, 254

(56) References Cited

U.S. PATENT DOCUMENTS

| | | | | |
|---|---|---|---|---|
| 2,026,082 | | 12/1935 | Darrow . | |
| 4,216,966 | | 8/1980 | MacRae . | |
| 4,283,059 | * | 8/1981 | Beeder | 273/254 |
| 4,323,249 | * | 4/1982 | Brady | 273/249 |
| 5,071,134 | * | 12/1991 | Burroughs, Jr. | 273/249 |
| 5,244,391 | * | 9/1993 | Bryant | 434/129 |
| 5,259,623 | * | 11/1993 | Kanelos | 273/249 |
| 5,350,179 | | 9/1994 | Hill et al. . | |
| 5,544,891 | * | 8/1996 | Gibson et al. | 273/244 |
| 5,645,279 | * | 7/1997 | Reutlinger | 273/249 |
| 5,722,658 | * | 3/1998 | Talmage et al. | 273/243 |
| 5,810,358 | * | 9/1998 | Manson | 273/251 |

* cited by examiner

*Primary Examiner*—William M. Pierce
(74) *Attorney, Agent, or Firm*—Eric Karich

(57) ABSTRACT

A board game for teaching responsible drinking to a plurality of players has a playing board having a start position and an end position connected by a pathway that extends about the surface of the playing board between the start position and the end position. The board game further includes a plurality of vehicle game pieces, each vehicle game piece being assigned to one of the plurality of players, and a plurality of a taxi game pieces. At least some of the playing positions provide an instruction, the instruction sometimes including a negative consequence of drinking instruction, or a cab calling instruction. The negative consequence of drinking instruction provides for some consequence having a negatively perceived effect upon the player who lands upon the playing position. The cab calling instruction allows the player to replace the vehicle game piece with the taxi game piece. The taxi game piece has the advantage of ignoring any of the negative consequence of drinking instructions upon which it might land, thereby teaching the players the desirability of calling a cab when a drinking.

3 Claims, 2 Drawing Sheets

BOARD GAME AND METHOD FOR TEACHING RESPONSIBLE DRINKING

CROSS-REFERENCE TO RELATED APPLICATIONS

This application for a utility patent claims the benefit of U.S. Provisional Application No. 60/152,474, filed Sep. 3, 1999.

STATEMENT REGARDING FEDERALLY SPONSORED RESEARCH

Not Applicable

BACKGROUND OF THE INVENTION

1. Field of the Invention

This invention relates generally to board games, and more particularly to a board game for teaching responsible drinking.

2. Description of Related Art

Various board games have been developed to teach certain skills and/or moral lessons. Darrow, U.S. Pat. No. 2,026,082, teaches a well-known board game commonly known as MONOPOLY®, which teaches trading and bartering in the field of real estate. As part of the game play, the game teaches players "trading and striking shrewd bargains."

Hill et al., U.S. Pat. No. 5,350,179, teaches a drug awareness board game. Players of this game assume the identities of police officers to fight a ware against crack cocaine. MacRae, U.S. Pat. No. 4,216,966, teaches a board game based on possible experiences of a player consuming liquor in relation to a time span in liquor establishments which includes a game board having a series of playing locations thereon and forming a playing path about the board. The liquor establishments are adjacent some of the playing locations. Player tokens are provided for moving on the playing locations and the stop locations. A pair of dice is used to move the player tokens about said playing and stop locations. A series of cards each bearing indicia indicating a type of drink, its liquor content, a message to the player, the amount of liquor consumed and the time spent during the consumption is provided. A blood alcohol concentration level chart is provided which has time increments versus ounces of liquor for ascertaining a state of drunkenness. A display board is provided which includes a dial for recording elapsed time and a dial to record the amount of liquor consumed. The player token is provided with a removable rigid head to indicate sobriety which is replaced by a head which flexes to indicate drunkenness. A series of cards is provided on each of which is indicia stating possible consequences to a player who is drunk and lands on a road hazard playing location. A police car is also provided as a means of eliminating a drunken driver from the game. The police car is moved in either direction on the path as dictated by dice.

The prior art teaches various board games that teach skills or moral lessons, including the dangers and consequences of drunk driving. However, the prior art does not teach a board game that teaches players to take a taxi cab home after drinking to avoid accidents or arrest. The present invention fulfills these needs and provides further related advantages as described in the following summary.

SUMMARY OF THE INVENTION

The present invention teaches certain benefits in construction and use which give rise to the objectives described below.

The present invention provides a board game for teaching responsible drinking to a plurality of players. The board game includes a playing board having a start position and an end position connected by a pathway that extends about the surface of the playing board between the start position and the end position. The board game further includes a plurality of vehicle game pieces, each vehicle game piece being assigned to one of the plurality of players, and a plurality of a taxi game pieces. At least some of the playing positions provide an instruction, the instruction sometimes including a negative consequence of drinking instruction, or a cab calling instruction. The negative consequence of drinking instruction provides for some consequence having a negatively perceived effect upon the player who lands upon the playing position. The cab calling instruction allows the player to replace the vehicle game piece with the taxi game piece. The taxi game piece has the advantage of ignoring any of the negative consequence of drinking instructions upon which it might land, thereby teaching the players the desirability of calling a cab when drinking.

A primary objective of the present invention is to provide a board game having advantages not taught by the prior art.

Another objective is to provide a board game that teaches responsible drinking to a plurality of players.

A further objective is to provide a board game that is easy to learn and fun to play.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a board game 10 for teaching responsible drinking to a plurality of players.

Figure 1:
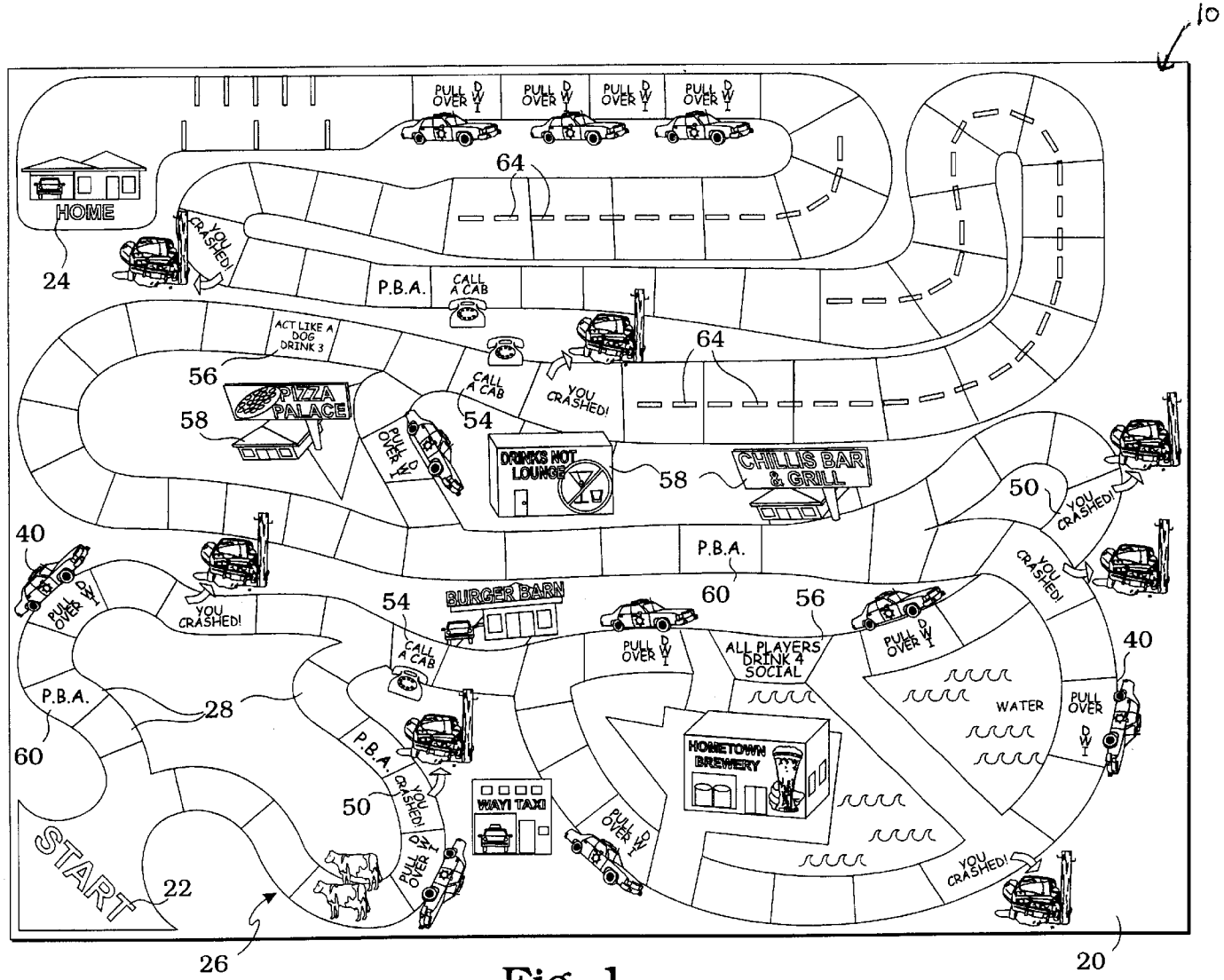
FIG. 1 is a top plan view of a playing board of the preferred embodiment of the present invention.

As shown in FIG. 1, the board game 10 includes a playing board 20 that provides the forum for the game action. The playing board 20 includes a start position 22 and an end position 24 connected by a pathway 26 that extends about the surface of the playing board 20 between the start position 22 and the end position 24. The pathway 26 is divided into a plurality of side by side shapes defining playing positions 28. In a simple embodiment, the pathway 26 is a simple and linear path, although the preferred embodiment includes a variety of interweaving branches that meander around the playing board 20 in a creative fashion. Each of the playing positions 28 is preferably roughly rectangular, although a variety of shapes can be used for the purpose of the board game 10.

Figure 2:
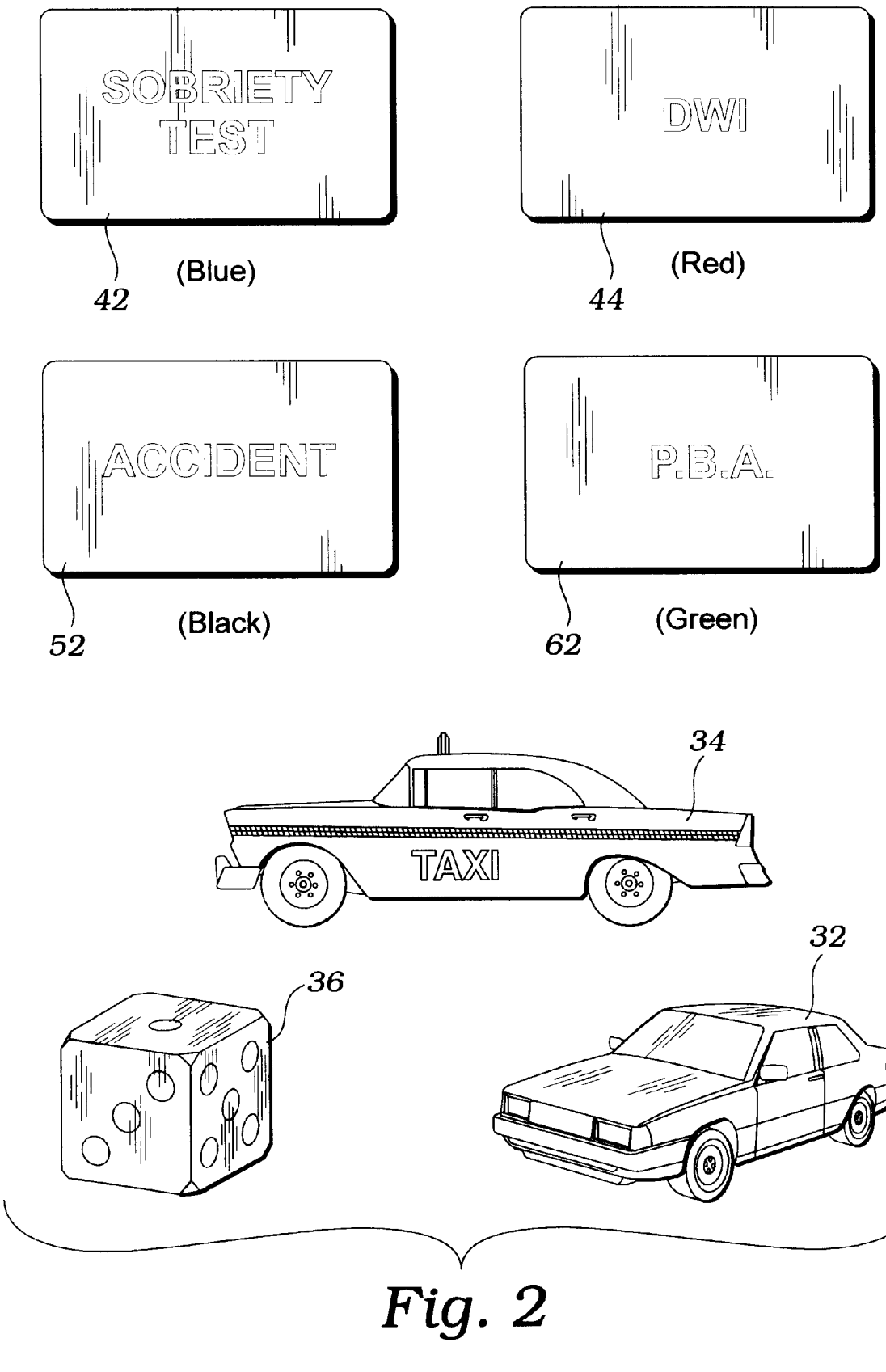
FIG. 2 is a top plan view of a variety of game accessories, including a plurality of playing cards, a die for randomly generating numbers, a vehicle game piece, and a taxi game piece.

As shown in FIG. 2, the board game 10 further includes a variety of game accessories 30 which facilitate game play. The variety of game accessories 30 include a plurality of vehicle game pieces 32, each vehicle game piece 32 being assigned to one of the plurality of players.

The vehicle game piece 32, preferably shaped to resemble an automobile, truck, van, motorcycle, or similar motorized transport, is movable in a player's turn a selected number of playing positions 28 upon the pathway 26 as dictated by a random number generator 36 such as a die or pair of dice. The variety of game accessories 30 game further include a plurality of taxi game pieces 34 whose functions are described in further detail below.

As shown in FIG. 1, at least some of the playing positions 28 provide an instruction. The instruction can be selected from a broad range of possibilities, but at least some of the instructions must include a negative consequence of drinking instruction 40 and 50, or a cab calling instruction 54. The negative consequence of drinking instruction 40 and 50 provides for some consequence having a negatively perceived effect upon the player who lands upon the playing position 28 bearing this instruction. Creative persons can undoubtably devise many interesting instructions to make the game interesting; however, in the preferred embodiment, the negative consequence of drinking instruction 40 and 50 takes one of two major forms.

In the first form, the negative consequence of drinking instruction is a DWI instruction 40 which reads "Pull Over, DWI." The DWI instruction 40 is designed to simulate getting pulled over by the police for drunken driving. While this effect can be achieved in a variety of ways, in the preferred embodiment the effect is achieved using one of a plurality of sobriety test playing cards 42 which are used to execute a sobriety test. The plurality of sobriety test playing cards 42 each include an instruction as to the execution of some sort of sobriety test, including physical and/or mental tests. While some of the tests are serious and emulate real tests administered by the police, others are entirely comical and are designed purely for fun. During play, the player who lands upon one of playing positions 28 having a DWI instruction (labeled "Pull Over, DWI"), the player must draw one of the plurality of DWI playing cards 44 and attempt to pass the test. The instruction on the DWI playing card 44 might instruct the player to attempt to say the alphabet backwards, for example, or walk a straight line, or touch his or her nose with his or her eyes closed. If the test is successfully passed, the player escapes unscathed, but if the test is failed the player must accept one of the plurality of DWI playing cards 44. The accumulation of three of the DWI playing cards 44 causes the player to terminate his or her participation in the board game 10.

In the second form, the negative consequence of drinking instruction is a crash instruction 50 which reads "You Crashed!" The crash instruction 50 is meant to simulate a possible consequence of drunken driving, namely the occurrence of an automobile accident. If the player lands upon this playing position 28, the player must accept one of a plurality of accident playing cards 52. The accumulation of three of the plurality of accident playing cards 52 causes the player to terminate his or her participation in the board game 10.

The cab calling instruction 54 provides a great benefit to the player lucky enough to land on the playing position 28 bearing this instruction. Upon landing upon the playing position 28 that includes the cab calling instruction 54, the player replaces his or her vehicle game piece 32 with one of the plurality of taxi game pieces 34. The taxi game piece 34 has the advantage of ignoring any of the negative consequence of drinking instructions 40 and 50 upon which it might land. Other advantages can also be added, as described in more detail below.

The board game 10 preferably includes additional elements that add to the fun of playing the game. In one embodiment, the board game 10 also functions as a drinking game, including a plurality of drinking instructions 56 that direct the player or players to consume given quantities of an alcoholic beverage, further adding to the amusing consequences of the sobriety tests While the player is actually drinking, he or she is being educated on the advantage of calling a cab rather than getting in an accident or being arrested by the police. Further fun instructions can include requiring the player to "Act like a Dog", or perform other amusing tasks or activities.

Another fun element of the board game 10 is the inclusion of various bars and restaurants 58 which cause further drinking and can cause the player to lose a turn. These various "pit stops" simulate many late night drinking expeditions, with drunken players stopping at additional bars, and also stopping at restaurants when they get the "munchies."

Finally, some of the playing positions 28 can include a PBA instruction 60, which allows the player to select one of a plurality of PBA cards 62. The PBA card 62 can be returned in exchange for avoiding the sobriety test received upon drawing one of the plurality of DWI playing cards 44. The PBA cards 62 can be saved, traded, and used to further enhance the excitement of the game.

While many prior art board games allow players to freely pass each other on the pathway 26, the board game 10 used in the present invention preferably does not always allow the vehicle game pieces 32 of the various players to pass each other so freely. Only some of the playing positions 28, marked with a dividing line 64, allow the vehicle game pieces 32 to pass each other. It is another advantage of the taxi game piece 34 that the player who has called a cab can also freely pass the other players regardless of the presence of the dividing line 64.

The sum of the benefits given to the players who successfully "call a cab" results in these players nearly always winning the game, while many of the players are eliminated due to accidents or DWI "convictions." The players enjoy drinking during the course of the game, and they leave with the lesson that winners call cabs so they can enjoy drinking without worrying about accidents and/or the police.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method for teaching responsible drinking to a plurality of players, the method comprising the steps of:

a) providing a playing board including:

a start position and an end position;

a pathway extending about the surface of the playing board between the start position and the end position, the pathway divided into a plurality of side by side shapes defining playing positions; and at least some of the playing positions providing an instruction, the instruction sometimes including a negative consequence of drinking instruction, or a cab calling instruction;

b) providing a plurality of vehicle game pieces and a plurality of taxi game pieces;

c) assigning one of the plurality of vehicle game pieces to each of the plurality of players;

d) randomly generating a number for each of the plurality of players in turn, advancing the one of the plurality of game pieces assigned to the respective one of the plurality of players along the pathway;

e) imposing a penalty upon the one of the plurality of players when the game piece assigned to the one of the plurality of players lands upon the negative consequence of drinking instruction; and f) replacing the vehicle game piece with the taxi game piece when the vehicle game piece lands upon the cab calling instruction, the taxi game piece making the one of the plurality of players immune to the negative consequence of drinking instruction.

2. The method of claim 1 further comprising the steps of:

providing a plurality of sobriety test playing cards and a plurality of DWI playing cards, each of the plurality of sobriety test playing cards having a sobriety test instruction;

selecting one of the plurality of sobriety test playing cards when the vehicle game piece lands on the negative consequence of drinking instruction;

attempting to complete the sobriety test instruction;

accepting one of the plurality of DWI playing cards if the sobriety test instruction is not successfully completed; and terminating the participation of any of the plurality of players who accumulate three of the plurality of DWI playing cards.

3. The method of claim 1 further comprising the steps of:

providing a plurality of accident playing cards;

selecting one of the plurality of accident playing cards when the vehicle game piece lands on the negative consequence of drinking instruction; and terminating the participation of any of the plurality of players who accumulate three of the plurality of accident playing cards.

* * * * *